United States Patent [19]

Underwood et al.

[11] Patent Number: 4,602,388

[45] Date of Patent: Jul. 29, 1986

[54] CHAFE-FREE ATHLETIC SHORTS

[76] Inventors: Carolyn G. Underwood, 240 Bay St., San Francisco, Calif. 94133; Douglas P. Balluff, 150 Lombard, #102, San Francisco, Calif. 94111

[21] Appl. No.: 619,091

[22] Filed: Jun. 11, 1984

[51] Int. Cl.[4] ..... A41D 9/00; A41B 9/00

[52] U.S. Cl. ..... 2/238; 2/402

[58] Field of Search ..... 2/238, 402, 404, 406

[56] References Cited

U.S. PATENT DOCUMENTS 1,539,659 5/1925 Fitzpatrick ..... 2/238

FOREIGN PATENT DOCUMENTS 1198902 7/1970 United Kingdom ..... 2/402

*Primary Examiner*—Doris L. Troutman

*Attorney, Agent, or Firm*—Townsend and Townsend

[57] ABSTRACT

Athletic shorts are disclosed which provide full support as well as maximum freedom of movement yet with minimum exposure. The construction consists of an underpant plus an outer shell of flexible fabric containing overlapping flap openings in front of each thigh extending from the waist to the bottom border. The construction permits full raising and splitting of the wearer's thighs without friction, and yet the flaps immediately close when the thighs are brought back together, providing full coverage.

5 Claims, 9 Drawing Figures

CHAFE-FREE ATHLETIC SHORTS

BACKGROUND OF THE INVENTION

Physical fitness and jogging in particular have gained increasing popularity in recent years to such an extent that they are no longer merely a means of improving and maintaining one's health and an attractive appearance but a social phenomenon as well. Jogging appeals to a broad range of persons of various shapes and sizes, including those who are desk-bound throughout the course of the normal working day and have disproportionately large hips and thighs.

Naturally, the high level of interest in jogging and other types of physical fitness pursuits has encouraged clothing merchants to offer a large line of apparel for running and exercise. Persons having large hips and thighs, however, generally find the shorts available on the market unsatisfactory, since they cause chafing at the sides and lower borders, resulting in discomfort to the wearer and restriction of freedom of movement. The problem is frequently alleviated by taking conventional running shorts and slitting them vertically along each side. This of course is unsightly and results in the embarrassing exposure of parts of the wearer's body.

SUMMARY OF THE INVENTION

The present invention provides athletic shorts of a novel construction which provide full support as well as substantially complete freedom of movement, yet do not expose to view the wearer's hips or adjacent regions. The shorts basically consist of an underpant plus an outer shell of flexible fabric, the outer shell containing overlapping flap openings in front of each thigh extending from the waist to the bottom border of the shell. These flap openings permit the full raising and splitting of the wearer's thighs without friction and yet immediately fall back into place with full coverage once the wearer's legs are brought back together.

DETAILED DESCRIPTION OF THE INVENTION

Figure 1A:
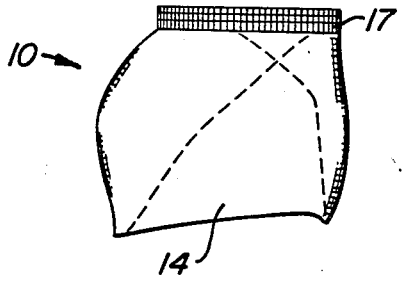
FIG. 1 depicts an illustrative embodiment of the present invention, showing the side, back and front views (FIGS. 1*a*, 1*b* and 1*c*, respectively) of the outer shell of the shorts, with the underpant shown in dashed lines.
Figure 1C:
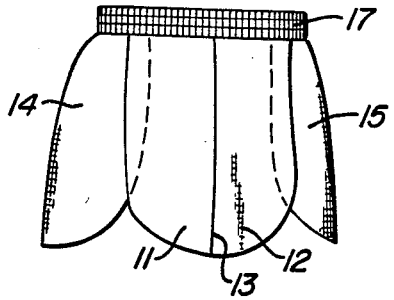
Figure 1B:
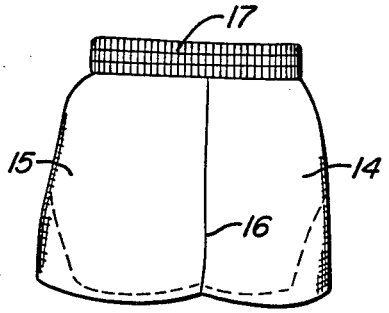

FIG. 1 offers three views of the shorts 10 of the present invention. The shell is formed of two pairs of panels—a front pair 11 and 12 joined at a vertical seam 13 over the center of the groin, and a side pair 14 and 15 joined at a vertical seam 16 over the crease of the buttocks. All four panels are sewn to the waistband 17 which they share with the underpant 18, shown in dashed lines underneath the shell.

The front and side panels overlap each other over the center of each thigh as shown in FIG. 1*c*, preferably with the front panel on top. The overlapping portions are not sewn together nor joined in any way. The degree of overlap is not critical and can vary widely. In preferred embodiments, the overlapping region is about 0.3 inch to about 3.0 inches in width. This permits the free opening and closing of the flap and sliding of one panel over the other.

Figure 2A:
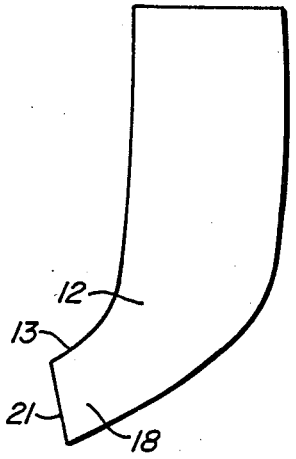
FIGS. 2*a* and 2*b* depicts the side and front panels of the shell shown in FIG. 1, laid out flat.
Figure 2B:
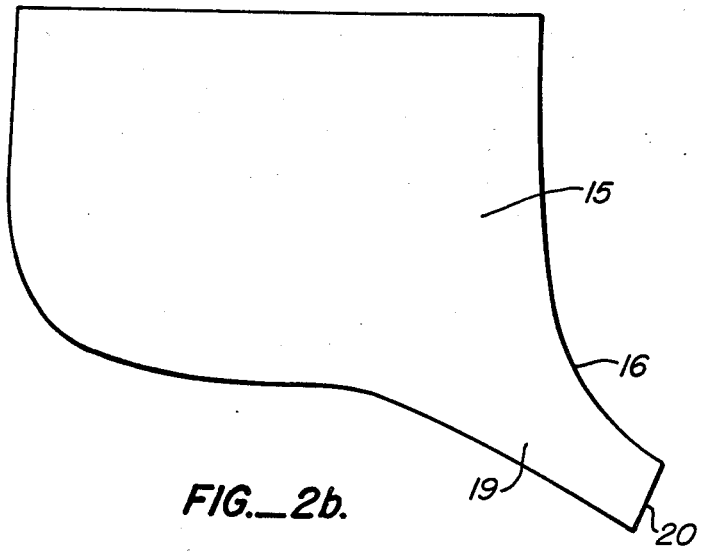

The individual panels are shown in FIG. 2. Specifically, front panel 12 is shown in FIG. 2*a*, while side panel 15 is shown in FIG. 2*b*. Each panel has a strip of material 18, 19 along the edge where the vertical seam is sewn. These strips extend between the thighs of the wearer, and are joined at their ends 20 and 21, thus connecting all four panels together. Preferably, the panels are not joined to the underpant at any part of the construction other than the waistband.

Figure 3A:
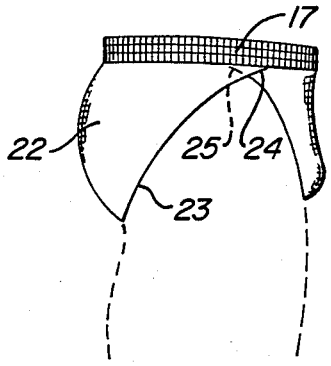
FIG. 3 shows side, back and front views (FIGS. 3*a*, 3*b* and 3*c*, respectively) of an illustrative underpant compatible with the shell embodiment of FIGS. 1 and 2.
Figure 3C:
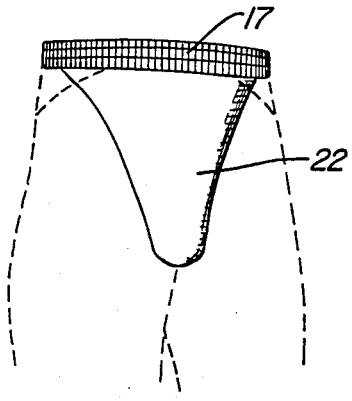
Figure 3B:
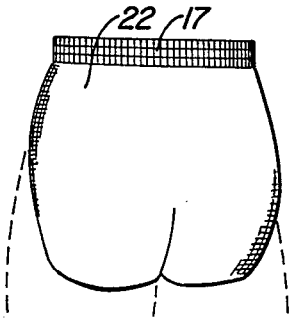
Figure 4:
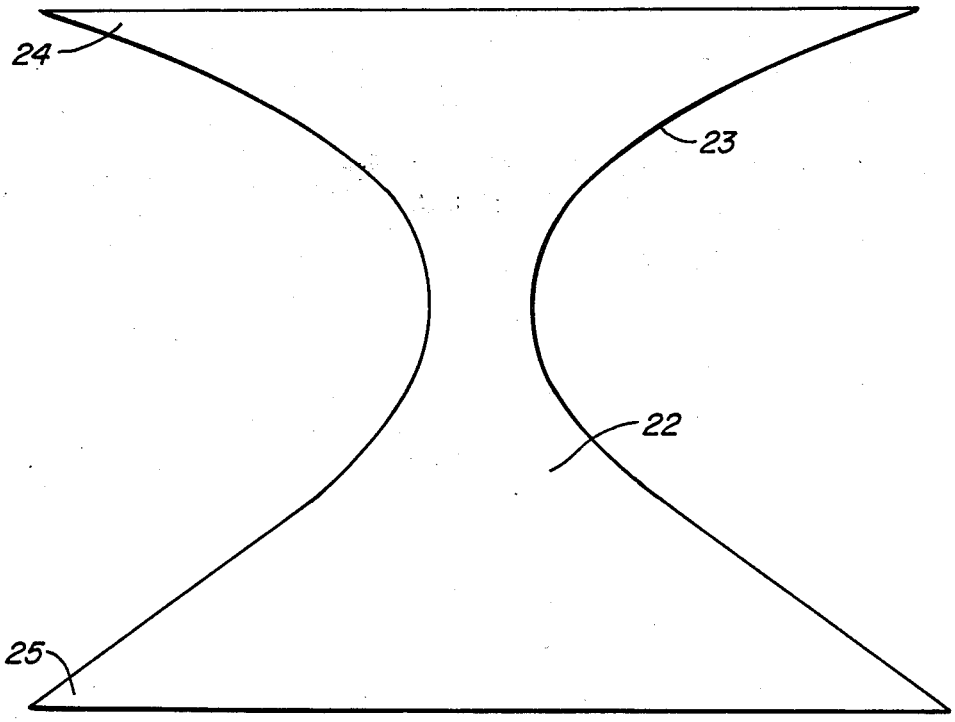
FIG. 4 depicts the underpant panel of FIG. 3 laid out flat.

The underpant 22 is shown in FIG. 3, in side, back and front views. The underpant has an elastic waistband 17 and elastic borders 23, and is shaped to fully enclose the buttocks and the external genitalia of the wearer, and provide adequate support for the latter during vigorous exercise to avoid chafing or injury. The underpant is preferably fabricated from a single piece of material as shown in FIG. 4, with highrise thigh openings to permit maximum freedom of movement of the thigh and cause a minimum of friction and chafing. This effect is conveniently achieved by overlapping the points 24 and 25 at the side of the hip., The foregoing description is offered primarily for purposes of illustration. It will be readily apparent to those skilled in the art that numerous modifications and variations of the features described above can be introduced without departing from the spirit and scope of the invention, as defined by the appended claims.

What is claimed is:

1. Athletic shorts comprising:

an underpant with elastic waistband and elastic borders to fully enclose and support the buttocks and groin of the wearer;

a pair of side panels, each extending from approximately the center of the front of one thigh of the wearer around the hip adjacent said thigh to the crease of the buttocks, said panels joined together along a rear seam at said crease to cover the seat of the wearer, and said panels joined along their upper borders to said underpant waistband; and a pair of front panels, each extending from approximately the center of the front of one thigh to a vertical line at the center of the groin, said front panels joined together along a front seam at said vertical line, and each joined along its upper border to said underpant waistband to loosely overlap said side panels;

each of said side and front panels further containing a strip of fabric extending downward along said rear and front seams to join together between the thighs of the wearer.

2. Athletic shorts in accordance with claim 1 in which said underpant borders are sloped upward toward said waistband at the sides thereof to define a high-rise leg opening which permits essentially unhindered movement of the hip joint of the wearer.

3. Athletic shorts in accordance with claim 1 in which said underpant is comprised of a single panel with narrowed center section to pass through the thighs of the wearer and widened straight edges to join said waistband, the corners of said panel tapering and overlapping at said waistband.

4. Athletic shorts in accordance with claim 1 in which said front panels are positioned in front of said side panels at said overlap.

5. Athletic shorts in accordance with claim 1 in which the overlapping portions of said front and side panels are from about 0.3 inch to about 3.0 inches in width.

* * * * *